United States Patent [19]

Maillard

[11] Patent Number: 4,628,635

[45] Date of Patent: Dec. 16, 1986

[54] ADJUSTABLE GATE

[76] Inventor: Susan Maillard, 47 Middle Line Ave., Medford, N.Y. 11765

[21] Appl. No.: 694,072

[22] Filed: Jan. 23, 1985

[51] Int. Cl.[4] ..... E06B 3/68

[52] U.S. Cl. ..... 49/55; 49/57

[58] Field of Search ..... 49/57, 55, 50, 56; 160/216, 215

[56] References Cited

U.S. PATENT DOCUMENTS

| | | | |
|---|---|---|---|
| 1,799,308 | 4/1931 | Matthiesen et al. | 49/55 X |
| 1,943,768 | 1/1934 | Melaas | 49/57 X |
| 2,594,864 | 4/1952 | Buckland et al. | 49/57 X |
| 3,163,205 | 12/1964 | Gottlieb | 49/55 X |
| 3,425,165 | 2/1969 | Cleveland | 49/57 X |
| 4,437,265 | 3/1984 | Turro et al. | 49/57 |

FOREIGN PATENT DOCUMENTS

| | | | |
|---|---|---|---|
| 2058186 | 4/1981 | United Kingdom | 49/55 |

*Primary Examiner*—Philip C. Kannan

*Attorney, Agent, or Firm*—F. R. Agovino

[57] ABSTRACT

The gate is located between opposing vertical surfaces such as door jambs. Left and right sections have their lower portions connected by an intermediate section which forms an opening for a door therebetween. Preferably, the gate comprises a lower horizontal member and an upper member having left and right horizontal portions and a center U-shaped portion in which the door is supported. Panels are located between the upper and lower portions. In use, the gate prevents passage between the door jambs but allows an adult to use the door to pass through the gate.

7 Claims, 3 Drawing Figures

ADJUSTABLE GATE

BACKGROUND OF THE INVENTION

1. Field of the Invention

The invention generally relates to adjustable gates and, in particular, to a removable gate structure which includes a door allowing passage through a portion of the gate.

2. Description of the Prior Art

Adjustable, removable gates are well known in the prior art as described in U.S. Pat. Nos. 641,272, 2,581,857, and 3,163,205, incorporated herein by reference. Such prior art gates are generally adapted to limit passage between two vertical surfaces such as the vertical jambs of a doorway. Frequently, such gates are primarily used to prevent children from passing through such doorways. Also, such gates are used to block steps or other dangerous areas from children. Often, it is necessary for adults to pass through such gates in which case the adult must step over the gate or remove the gate. The prior art does not address the problem of providing a gate structure which prohibits passage of children through but provides easy access for adults to pass through. The invention is directed to solving this problem.

SUMMARY OF THE INVENTION

It is an object of this invention to provide a gate which can be used to inhibit child passage through a passageway yet permit an adult to easily pass through the gate. It is another object of this invention to provide a gate having a door which allows adults to pass through the gate with ease.

The gate according to the invention is adapted for use between opposing left and right surfaces for obstructing passage therebetween. The gate comprises a left section which is substantially flat and has at least one substantially rigid structural element. First means are connected to the left section for engaging the left vertical surface. The gate also includes a right section which is substantially flat and has at least one substantially rigid structural element. Second means are connected to the right section for engaging the right vertical surface. An intermediate section of at least one substantially rigid structural element interconnects a lower portion of the left and right sections. The left, right and intermediate sections define an opening between the left and right sections and above the intermediate section. A substantially flat door section of at least one substantially rigid structural element is located within the opening. Third means are located between the left section and the door for supporting the door within the opening. Fourth means are located between the right section in the door for supporting the door within the opening. The left, right and intermediate sections may comprise a lower substantially horizontal rigid member and an upper rigid member having left and right horizontal portions interconnected by a U-shaped portion. One or more panels is connected between the upper and lower members.

BRIEF DESCRIPTION OF THE DRAWINGS

These features and objects of the invention as well as others will become apparent to those skilled in the art by referring to the following specification and accompanying drawings in which.

DETAILED DESCRIPTION OF THE INVENTION

Figure 1:
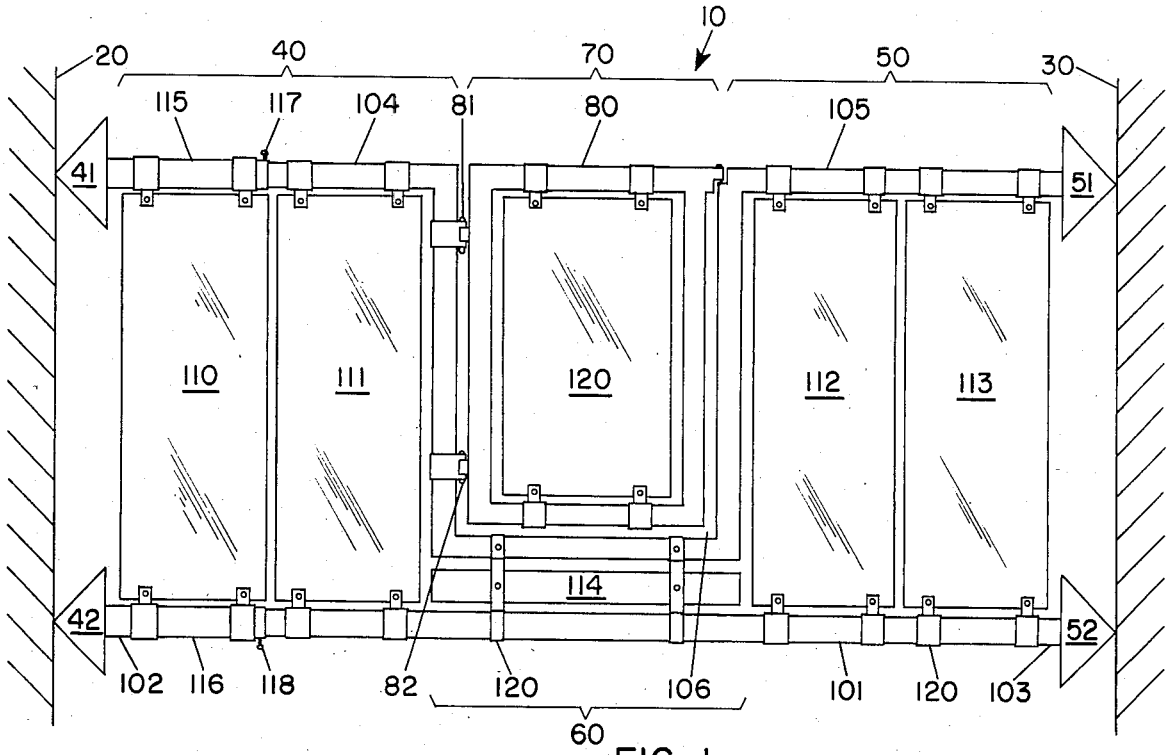
FIG. 1 is a frontal, planar view of a removable gate according to the invention.

Referring to FIG. 1, the gate 10 according to the invention is adapted for use between apposing vertical surfaces such as left vertical surface 20 and right vertical surface 30. The purpose of the gate is to obstruct passage therebetween. For example, vertical surfaces 20 and 30 may be opposing sides or jambs of a door opening or an opening leading to steps or other dangerous areas where children should be prevented from entering.

The structure of the gate generally includes a left section 40, a right section 50 and an intermediate section 60 which interconnects a lower portion of left section 40 and right section 50. Each section is substantially flat and made of at least one substantially rigid structural element.

Means are provided so that the left and right sections 40, 50 engage the left and right vertical surfaces 20, 30. For example, as shown in FIG. 1, left section 40 and right section 50 may be provided with resilient members 41, 42, 51, 52 for engaging the vertical surfaces 20, 30, respectively.

Between the left section 40 and the right section 50 and above the interconnecting, intermediate section 60, an opening 70 is defined in which a door section 80 is located. Door section 80 is a substantially flat section made of at least one substantially rigid structural element which is configured to fit in opening 70. Means are located between the left section 40 and the door 80 for supporting said door within the opening. As shown in FIG. 1, hinges 81 and 82 interconnect left section 40 and door 80 so that door 80 is disposed within opening 70 and can be rotated about the hinges thereby making opening 70 accessible.

Figure 2:
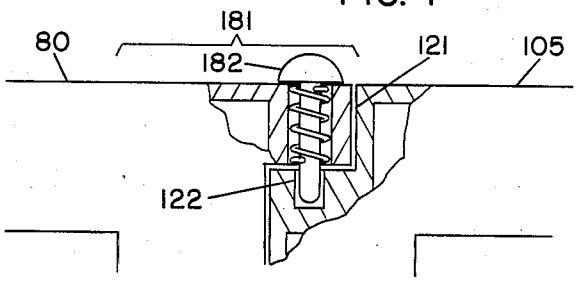
FIG. 2 is a partial expanded view of the locking device located between the door and one section of the gate according to the invention.

Means are provided between the right section and said door for supporting door 80 within the opening. As generally shown in FIG. 1 and shown in detail in FIG. 2, said means may be a child proof locking device which interconnects said door 80 and the right section 50. FIG. 2 will be described in greater detail below.

In the embodiment as shown in FIG. 1, the left, right and intermediate sections 40, 50, 60 are integrally defined by a lower substantially horizontal rigid member 101 having a left end 102 supporting resilient member 42 and a right end 103 supporting another resilient member 52. The left and right sections are further defined by another rigid member having a left substantially horizontal portion 104 and a right substantially horizontal portion 105 supporting resilient members 41, 51 respectively. U-shaped member 106 defines opening 70 and is rigidly connected to horizontal portions 104 and 105.

Located between lower member 101 and the upper member including portions 104, 105, and 106, and panels 110, 111, 112, 113 and 114. The purpose of these panels is to add strength and rigidity to the gate 10 and further prevent passage of children or animals between the upper and lower members. Panels 110 and 111 may overlap (not shown) to accommodate the adjustable length of the gate.

It is contemplated that the gate 10 according to the invention may have an adjustable length. For example, as shown in FIG. 1, left portion 104 and the left end of lower member 101 may be provided with telescoping members 115, 116, respectively, so that the length of gate 10 may be extended to properly fit in the space between left vertical surface 20 and right vertical surface 30. The telescoping members may be provided with a locking device such as pins 117, 118 which engage the telescoping members through aligned rows of holes located therein so that the adjustable length of the gate 10 may be locked and fixed. This permits a tight frictional fit between left vertical wall 20 and right vertical wall 30 so that the resilient members 41, 42, 51, 52 firmly engage the vertical surfaces. Alternatively, other portions of the gate may telescope or have adjustable lengths.

The upper and lower members are also provided with some means for supporting panels 110–114. For example, brackets 120 may be attached to the horizontal members for engaging the panels by screws, nuts and bolts or any other well known expedient.

It is contemplated that the gate 10 according to the invention may be made of any substantially rigid structure. As illustrated in FIG. 1, upper and lower members and door 80 may be fabricated of a tubular construction. Door 80 must be a substantially solid structure to prevent children from passing therethrough. As shown in FIG. 1, door 80 may also be provided with a panel 120. Alternatively, a plurality of panels similar to panels 110–114 may be located within the opening defined by the outer tubular structure of door 80. Door 80 and intermediate portion 60 may have adjustable lengths.

FIG. 2 is an expanded detail of the child proof lock interconnecting door 80 and right horizontal portion 105. Any well known child proof lock may be used to interconnect door 80 and section 50. Alternatively, if door 80 is slidably supported by section 40, it may be unnecessary to provide a separate child proof lock therefor. As shown in detail in FIG. 2, a portion of door 80 extends to the right as member 81 and engages a notch 121 in the right horizontal member 105. Portion 81 may be provided with a spring loaded pin 82 for engaging an opening 122 within the horizontal member 105.

Figure 3:
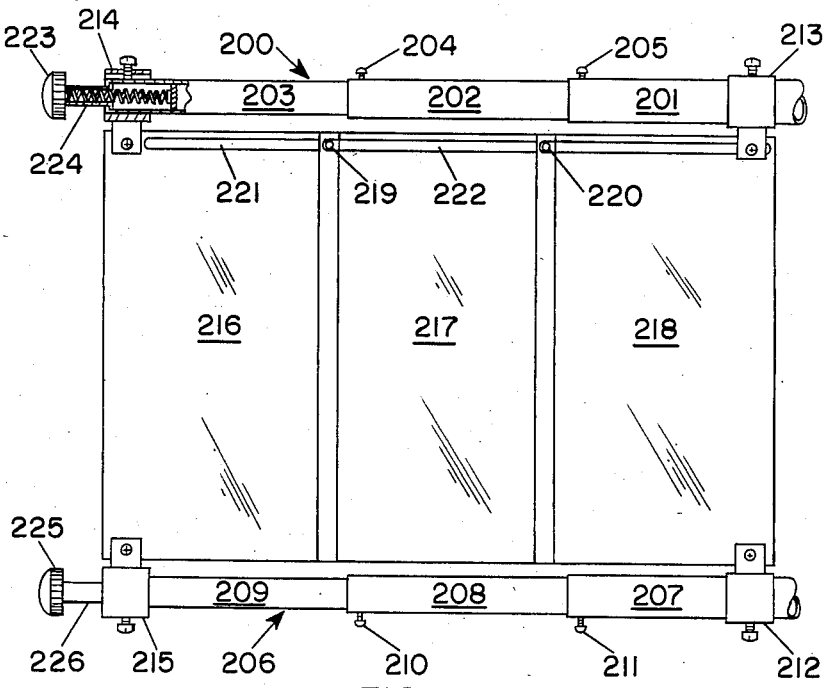
FIG. 3 is a partial frontal, planar view of another embodiment of a section of the gate according to the invention.

FIG. 3 is a partial view of left section 40 and is an alternative embodiment as compared to the structure as shown in FIG. 1. As shown in FIG. 3, left horizontal portion 200 is comprised of telescoping members 201, 202 and 203 which may be locked to each other by locking screws 204 and 205. Similarly, lower horizontal member 206 comprises telescoping members 207, 208 and 209 which may be held in place by locking screws 210 and 211.

Member 207 is provided with bracket 212, member 201 is provided with bracket 213, member 203 is provided with bracket 214 and member 209 is provided with bracket 215. These brackets support panels 216, 217 and 218 which slidably engage each other through pins 219 and 220 and slots 221, 222. Member 203 is provided with a resilient end 223 which is held in place by a spring and collar combination 224. Portion 209 is similarly provided with resilient member 225 and spring and collar combination 226.

In use, the gate according to the invention is adjusted in length or otherwise frictionally fitted between vertical surfaces 20 and 30 so that the gate is firmly held in place. Once in place, the gate prevents young children or animals from passing between the vertical surfaces which it engages. However, an adult may easily pass through the gate by opening door 80 and stepping therethrough. In this way, adults may pass through the passageway without the need for removing the gate yet children and animals are prevented from passing through the passageway because the gate remains in place.

Other features and objects of the invention will become apparent to those skilled in the art. The scope of the invention is defined by the following appended claims.

What is claimed is:

1. A gate adapted for use between opposing left and right vertical surfaces for obstructing passage therebetween, said gate comprising:

a substantially flat left section comprising at least one substantially rigid structural element;

first means connected to said left section for engaging the left vertical surface;

a substantially flat right section comprising at least one substantially rigid structural element;

second means connected to said right section for engaging the right vertical surface;

an intermediate section comprising at least one substantially rigid structural element, said intermediate section interconnecting a lower portion of said left and right sections;

said left, right and intermediate sections defining an opening between said left and right members and above said intermediate section;

a substantially flat door section comprising at least one substantially rigid structural element, said door being configured to fit within said opening;

third means for interconnecting said intermediate section and said door and for supporting said door within said opening;

wherein said left, right and intermediate sections comprise:

a lower, substantially horizontal rigid member having left and right ends engaging the first and second means, respectively;

an upper, substantially rigid member having left and right substantially horizontal portions, said portions having outer ends engaging the first and second means, respectively, and inner ends interconnected by a U-shaped portion defining the opening; and one or more panels connected between said upper and lower members.

2. The gate of claim 1 wherein said third means comprises hinges located between and connected between said door and said U-shaped member.

3. The gate of claim 2 further comprising a locking device located between and selectively inerconnecting said door and said U-shaped member for selectively preventing the swinging of said door.

4. The gate of claim 3 wherein said upper and lower members are telescoping members having adjustable lengths.

5. The gate of claim 4 wherein said first and second means are spring-loaded resilient members supported on and connected to the left and right ends of said lower members and the outer ends of said portions.

6. The gate of claim 5 wherein said one or more panels each comprises:

a first panel having a left upper end connected to the outer end of the left portion of the upper member, a left lower end connected to the left end of the lower member, and a horizontal slot located therein;

a second panel having a right upper end connected to the inner end of the left portion of the upper member, a right lower end connected to the lower member, and a horizontal slot located therein; and means interconnecting and slidably engaging said slots.

7. The gate of claim 6 wherein said slots are in registry and said interconnecting means is a pin.

* * * * *